United States Patent [19]

Pinson

[11] Patent Number: 4,684,080

[45] Date of Patent: Aug. 4, 1987

[54] PRESSURE GAS SUPPLY FOR A MISSILE AND THE LIKE

[75] Inventor: George T. Pinson, Huntsville, Ala.

[73] Assignee: The Boeing Company, Seattle, Wash.

[21] Appl. No.: 741,856

[22] Filed: Jun. 6, 1985

[51] Int. Cl.[4] ..... F42B 15/033

[52] U.S. Cl. ..... 244/3.22; 102/293

[58] Field of Search ..... 244/3.22, 3.21, 3.1; 102/293, 530, 531; 62/50; 122/30; 219/201, 275, 325, 326

[56] References Cited

U.S. PATENT DOCUMENTS

| | | | |
|---|---|---|---|
| 2,965,334 | 12/1960 | McCullough, Jr. et al. | 244/3.22 |
| 3,502,285 | 3/1970 | Gambill | 244/3.22 |
| 3,740,003 | 6/1973 | Ayre et al. | 244/3.22 |
| 4,085,909 | 4/1978 | East et al. | 244/3.21 |
| 4,406,863 | 9/1983 | Jenkins | 102/530 |
| 4,413,795 | 11/1983 | Ryan | 244/3.22 |

*Primary Examiner*—Charles T. Jordan

[57] ABSTRACT

A high pressure gas supply system used for storing and activating a fluid in a liquid form and converting the liquid to a high pressure gas when needed. The high pressure gas is used for the control and stability of missile fin actuators, canards, hot or cold gas thrusters and other applications on a missile.

10 Claims, 1 Drawing Figure

PRESSURE GAS SUPPLY FOR A MISSILE AND THE LIKE

BACKGROUND OF THE INVENTION

Heretofore, missile stability and control was normally accomplished through the use of fin actuators, canards and hot or cold gas thrusters. Many of the existing designs used high pressure gas stored in pressure bottles. Missiles and projectiles are designed for storage lives of from 10 to 20 years. Over the storage life the high pressure gases can escape from a pressure bottle. Since pressure may be in the 10,000 psi range, loss of pressurization presents a reliability problem. The subject invention eliminates the problem of pressure loss by activating a fluid in a liquid form and converting the liquid to a high pressure gas at the time it is needed.

Prior to the subject invention, methods were developed to provide high pressure gas which included storage of liquids that reacted violently to generate a gas, high pressure gas storage systems and hot gas generators.

The use of two or more liquids that react exothermally to produce a hot gas is well known. This technique is used in large rockets for propulsion purposes. This type of technique has not been used to power control systems. The liquids pose a danger if inadvertently spilled or exposed to each other. Therefore, this technique is not widely used in man-portable weapon systems.

The cold gas high pressure storage system commonly used in a steel pressure bottle must be overdesigned to permit it to withstand handling and rigorous missile qualification tests. The pressures normally used are between 9,000 and 11,000 psi. The bottles have a tendency to develop slow leaks especially with light gases such a helium. The pressurization loss cannot be detected and therefore a missile or projectile may be fired with no gas pressure to power the control system or the like.

To circumvent gas leakage problems, hot gas generators have been developed. These generators usually use propellant as a source of high pressure gas. The propellant is ignited normally by an electrically or impulse fired squib. The gases are generated by the burning of the propellant. This type of gas generator has three major flaws. First, once the propellant is ignited, it burns at a fixed rate requiring that the excess gas be dumped. Secondly, the gases are very hot and may be in the excess of 2,000° Fahrenheit. This creates a problem with insulating the control system actuators and the other missile components from this temperature. Finally the gas is similar to that generated by burning rubber tires and usually dirty and possibly corrosive. The solid contaminants must be removed to avoid clogging up the gas passage ways and condensing out in the controller. This is less of a problem if the hot gases are used in an impulse or propulsive controller since the plumbing can be relative short.

In the following U.S. patents: U.S. Pat. No. 4,092,830 to Rilett; U.S. Pat. No. 4,149,388 to Schneider et al; U.S. Pat. No. 4,163,371 to Groninger; U.S. Pat. No. 4,219,725 to Groninger and U.S. Pat. No. 4,255,646 to Dragoy et al various types of portable cryogenic power systems and liquified gas vessels are described. None of these prior art gases provide the unique features and advantages of the subject high pressure gas supply system for use in conjunction with missile control systems.

SUMMARY OF THE INVENTION

The subject invention uses a clean inert fluid and gas such as freon that can be pressurized in a liquid state under moderate pressures.

The sealing of the gas supply system is not a problem since the fluid normally does not escape because of its high molecular weight and low pressure.

The system provides for electrical heating of the liquid and reheating of the liquid and gas as it expands thereby obtaining a complete mixing of the gas.

The liquified fluid, when heated may be created into a gas in excess of 2,000 psi which escapes through a high pressure gas regulator and transferred to a working apparatus such as a fin actuator or a cold gas jet actuator. The pressurized gas may also be used to provide pneumatic power to any applicable gas powered subsystem.

The subject invention solves the pressure loss problems heretofore related to gas supply systems in missiles and the like by storing and activating a fluid in a liquid form and converting the liquid to a high pressure gas when it is needed.

The high pressure gas supply for a missile and the like includes a pressure vessel for storing the liquid under pressure therein. Inside the pressure vessel is a gas tube with gas tube orifices for receiving gas when it is converted from a liquid. Surrounding the gas tube are heating coils. When the liquid is heated, it expands into a gas in a vaporizing chamber. The gas is expanded into a vapor heating chamber which again heats the gas prior to the gas reaching a preset pressure before it is discharged out a gas outlet which is opened by a seal cutter operated by a squib actuator controller.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
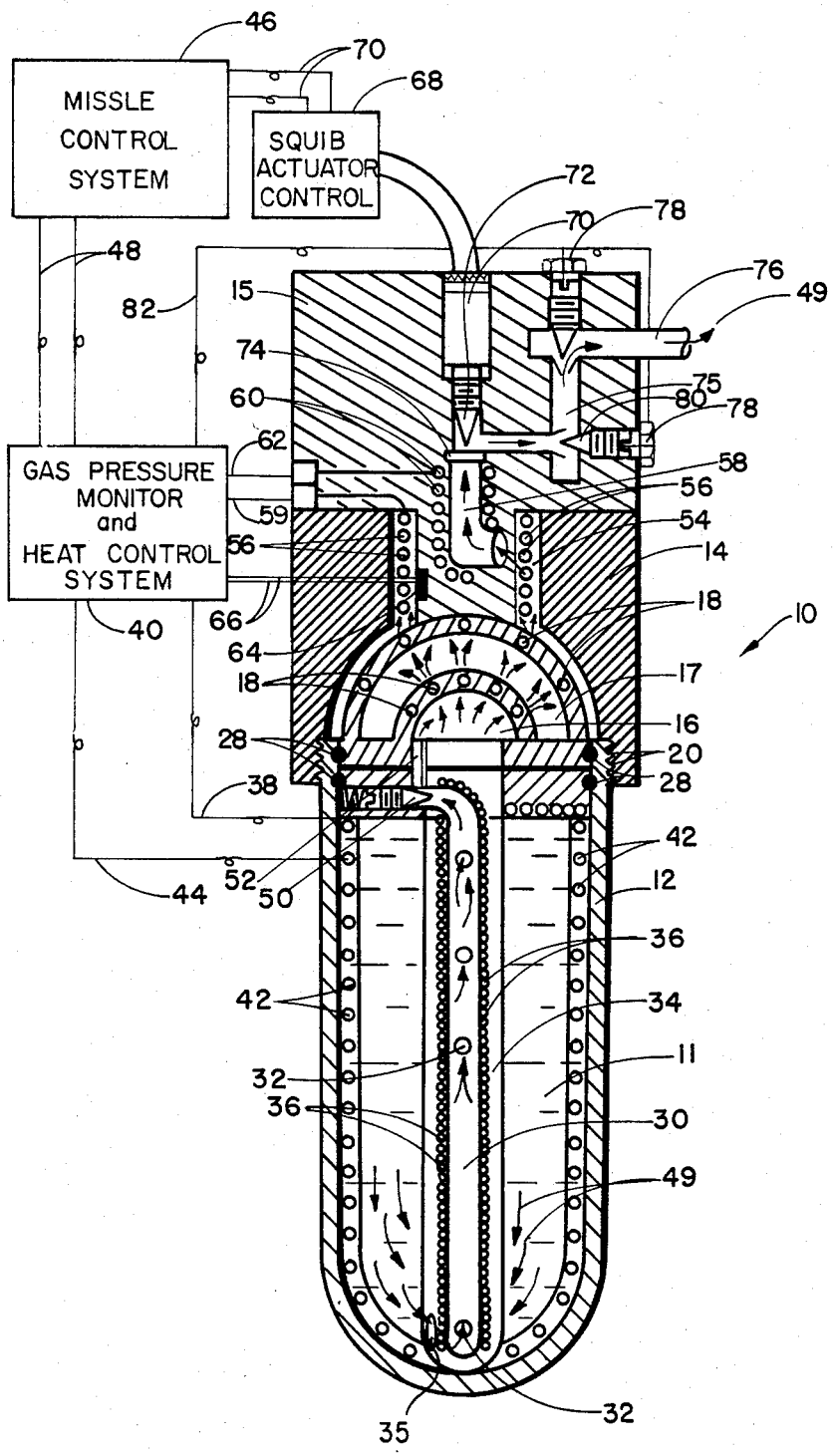
FIG. 1 is a front sectional view of the high pressure gas supply system.

In FIG. 1 the high pressure liquid gas supply system is designated by general reference numeral 10. The system 10 includes liquid 11 housed in a pressure vessel 12. The liquid 11 may be from a wide variety of materials such as freon that is easily vaporized by heating. The pressure vessel 12 is capped by a gas vapor housing 14 and a gas outlet housing 15. The housing 14 includes vaporizing chambers with vapor jets 18.

The pressure vessel 12 is filled with the suitable liquid 11 with the housing 14 attached to the pressure vessel 12 by threaded screws 20 or any other suitable means. The liquid and subsequent gases are prevented from escaping the pressure vessel 12 by "O" rings 28. Inside the vessel 12 and surrounded by the liquid 11 is a gas tube 30 having a plurality of gas tube orifices 32. Surrounding the gas tube 30 and inside an external tube 34 is a heating coil 36 connected to a lead 38 which is under the control of a gas pressure monitor and heating control system 40. Surrounding the liquid in the vessel 12 is another heating coil 42 which is also connected to a lead 44 attached to the heating control system 40. The gas pressure monitor and heating control system 40 is under the command of a missile control system 46 connected thereto by leads 48. When the missile control system 46 actuates the gas pressure monitor and heating control system 40 and the heating coil 36 and 42 are activated, the heated liquid begins to expand and escape through an aperture 35 in the bottom of tube 34 and then through the tube orifices 32 into the gas tube 30.

When the heated liquid or gas indicated by arrows 49 reach a preset temperature a spring-loaded pressure regulator valve 50 is opened allowing the mixture to enter an expansion port 52 wherein the liquid and/or gas is received into the lower vaporizing chamber 16 where it is discharged out lower jets 18 and sprayed into an atomizer in upper chamber 17 where again the mixture is discharged out upper jets 18 into a vapor heating chamber 54. Surrounding the vapor heating chamber 54 is a heating coil 56 connected to a lead 59 which is also under control of the heat control system 40. As the liquid and gas mixture begin to expand, superheating of the gas is required to compensate for cooling due to the expansion of the liquid and gas mixture. This is accomplished by the vaporizing chamber heating coils 56. As the gas continues to expand, it is discharged through a gas outlet 58 which is surrounded by a final heating coil 60 connected to lead 62 attached to the heat control system 40.

The gas pressure monitor and heat control system 40 is also connected to a feedback pressure sensor 64 by leads 66. The feedback pressure sensor 40 provides input to the control system 40 and to the missile control system 46 for actuating a squib actuator control 68 via leads 70. The controller 68 is connected to a seal cutter squib and initiator 70 mounted on top of a seal cutter 72. When the pressure sensor 64 provides the necessary feedback that a predetermined pressure has been reached by the vaporized gas, the missile control system 46 actuates the controller 68 which in turn signals the initiator 70 with a firing pulse which ignites the seal cutter 72. The cutter 72 opens a gas seal 74 so the vaporized gas can escape through outlet port 75 and discharged through gas line 76. Control of the escaping gas and regulating a desired amount of gas is provided by rotary solenoids 78 connected to needle valves 80. The rotary solenoids 78 are connected by a lead 82 to the heat control system 40.

From reviewing the above described structure of the pressure gas supply system 10 it can be seen that by applying direct electrical heat of the stored liquid 11 in the vessel 12 and by expanding the gas into the vaporizing chamber 16 and 17 and vapor chamber 54, a complete mixing of the gas is obtained. The effects of cooling due to the expansion of the gas through the various jet orifices 18 is compensated for by the heating coils 56 and 60 which superheat the gas vapor prior to the discharging the gas from the system 10. Further the pressure sensor 64 measures the gas pressure in the system 10 and is compared with a desired pressure as commanded by the missile control system 46 through the gas pressure monitor and heat control system 40. If the pressure falls below a preset lower level, the electrical power to the leads 38, 44, 59 and 62 is increased until the desired pressure is reached. If the pressure is too high the electrical power is reduced. Output gas pressure and volume are controlled by rotary solenoids 78.

Changes may be made in the construction and arrangement of the parts or elements of the embodiments as described herein without departing from the spirit or scope of the invention defined in the following claims.

What is claimed is:

1. A high pressure gas supply system under the control of a missile control system, the supply system comprising:

a pressure vessel for storing a liquid, under pressure, therein;

a first means for heating the liquid in the vessel;

a vaporizing chamber attached to the vessel for receiving the heated liquid and gas therefrom;

a second means for superheating the gas as it is received from the vaporizing chamber into a vapor heating chamber;

a gas outlet communicating with the vapor heating chamber for receiving the heated gas therefrom, the gas outlet having a seal therein; and means for cutting the seal and allowing the gas to be discharged from the supply system when a predetermined pressure is reached.

2. The supply system as described in claim 1 further including a third means for heating the vaporized gas and disposed around the gas outlet for superheating the gas as it expands from the vaporizing chamber.

3. The supply system as described in claim 1 further including a gas tube received in the pressure vessel and having orifices therein, the gas tube receiving the heated liquid and gas from the vessel, the gas tube communicating with the vaporizing chamber.

4. The supply system as described in claim 3 wherein a spring loaded pressure regulator valve is disposed between the gas tube and vaporizing chamber, the valve opening when a predetermined pressure is reached discharging the liquid and gas into the vaporizing chamber.

5. The supply system as described in claim 1 wherein the gas outlet is formed in a gas outlet housing, the housing having a plurality of gas pressure regulator valves therein and controlled by solenoids for regulating the amount of discharge of the vaporized gas from the gas outlet.

6. The supply system as described in claim 1 further including a feedback pressure sensor mounted in the vapor chamber and connected to a gas pressure monitor and heat control system, the gas pressure monitor and control system connected to the first means for heating the liquid and the second means for heating the liquid so the heating of the liquid and gas can be monitored when the liquid and gas is heated herein.

7. A high pressure gas supply system under the control of a missile control system, the supply system comprising:

a pressure vessel for storing a liquid under pressure therein;

a gas tube disposed in the pressure vessel and having orifices therein;

a first means for heating the liquid in the pressure vessel and surrounding the pressure vessel and the gas tube;

a vaporizing chamber attached to the vessel and communicating with the gas tube for receiving the heated liquid and gas therefrom;

a vapor heating chamber communicating with the vaporizing chamber and having a second means for heating the gas as the gas is received in the vapor heating chamber;

a gas outlet housing having a gas outlet therein and communicating with the vapor heating chamber, the gas outlet having a seal therein; and means for cutting the seal and allowing the gas to be discharged from the gas outlet.

8. The supply system as described in claim 7 further including a seal cutter squib and initiator connected to a seal cutter, the seal cutter squib and initiator connected to a squib actuator controller under the control of the missile control system for receiving a firing pulse so the seal cutter can open the seal and allow the gas to be used at a predetermined pressure.

9. The supply system as described in claim 7 further including a gas pressure monitor and heat control system connected to the missile control system and the first means for heating the liquid and the second means for heating the liquid so the heating of the liquid and gas can be controlled at predetermined temperatures and pressures.

10. The supply system as described in claim 9 further including a feedback pressure sensor mounted in the vapor heating chamber and connected to the gas pressure monitor and heat control system for providing feedback pressure data as the vaporized gas is expanded from the vaporizing chamber into the heat vapor chamber.

* * * * *

UNITED STATES PATENT AND TRADEMARK OFFICE

CERTIFICATE OF CORRECTION

PATENT NO. : 4,684,080

DATED : August 4, 1987

INVENTOR(S) : George T. Pinson

It is certified that error appears in the above-identified patent and that said Letters Patent is hereby corrected as shown below:

Col. 1, line 38, change "a" to --as--.

Signed and Sealed this

First Day of December, 1987

*Attest:*

DONALD J. QUIGG

*Attesting Officer*

*Commissioner of Patents and Trademarks*